US009168637B2

(12) United States Patent
Mizuno et al.

(10) Patent No.: US 9,168,637 B2
(45) Date of Patent: Oct. 27, 2015

(54) VITRIFIED SUPER-ABRASIVE-GRAIN GRINDSTONE

(71) Applicants: Akihiro Mizuno, Nagoya (JP); Norio Imai, Nagoya (JP); Kouichi Yoshimura, Nagoya (JP); Takeshi Mishima, Nagoya (JP)

(72) Inventors: Akihiro Mizuno, Nagoya (JP); Norio Imai, Nagoya (JP); Kouichi Yoshimura, Nagoya (JP); Takeshi Mishima, Nagoya (JP)

(73) Assignee: NORITAKE CO., LIMITED, Nagoya (JP)

( * ) Notice: Subject to any disclaimer, the term of this patent is extended or adjusted under 35 U.S.C. 154(b) by 0 days.

(21) Appl. No.: 14/372,955

(22) PCT Filed: Jan. 18, 2013

(86) PCT No.: PCT/JP2013/050995

§ 371 (c)(1),
(2) Date: Jul. 17, 2014

(87) PCT Pub. No.: WO2013/108898

PCT Pub. Date: Jul. 25, 2013

(65) Prior Publication Data

US 2014/0349557 A1 Nov. 27, 2014

(30) Foreign Application Priority Data

Jan. 18, 2012 (JP) ..... 2012-008512

(51) Int. Cl.
*B24D 3/14* (2006.01)
*B24D 5/06* (2006.01)

(52) U.S. Cl.
CPC ... *B24D 3/14* (2013.01); *B24D 5/06* (2013.01)

(58) Field of Classification Search
CPC ..... B24D 3/14; B24D 3/16; B24D 5/06; B24D 5/063; B24D 5/066; B24D 5/08
See application file for complete search history.

(56) References Cited

U.S. PATENT DOCUMENTS

| | | | | |
|---|---|---|---|---|
| 6,007,591 | A * | 12/1999 | Watanabe | 51/297 |
| 6,012,977 | A * | 1/2000 | Yoshikawa et al. | 451/541 |
| 6,086,467 | A * | 7/2000 | Imai et al. | 451/541 |
| 2003/0114085 | A1 | 6/2003 | Choi et al. | |
| 2005/0081454 | A1 | 4/2005 | Ohtsubo et al. | |
| 2010/0139173 | A1 * | 6/2010 | Soma et al. | 51/296 |
| 2013/0084786 | A1 * | 4/2013 | Rehrig et al. | 451/539 |
| 2013/0199107 | A1 * | 8/2013 | Fries | 51/309 |

FOREIGN PATENT DOCUMENTS

| | | |
|---|---|---|
| JP | A-49-059387 | 6/1974 |
| JP | A-02-274465 | 11/1990 |
| JP | A-06-262527 | 9/1994 |

(Continued)

OTHER PUBLICATIONS

Feb. 19, 2013 International Search Report issued in International Patent Application No. PCT/JP2013/050995.

*Primary Examiner* — Dong Van Nguyen
(74) *Attorney, Agent, or Firm* — Oliff PLC

(57) ABSTRACT

A vitrified superabrasive grain grinding stone includes superabrasive grains including a CBN abrasive grain as a main abrasive grain and a diamond abrasive grain as an auxiliary abrasive grain bonded together by use of a vitrified bond. The auxiliary abrasive grain has an average grain diameter equal to ½ to 1/10 of that of the main abrasive grain, and the auxiliary abrasive grain has a toughness value of 0.4 to 1 when that of the main abrasive grain is given as 1.

5 Claims, 10 Drawing Sheets

(56) References Cited

FOREIGN PATENT DOCUMENTS

| | | |
|---|---|---|
| JP | A-2000-158347 | 6/2000 |
| JP | A-2000-343438 | 12/2000 |
| JP | A-2002-178265 | 6/2002 |
| JP | A-2003-025232 | 1/2003 |
| JP | A-2003-300165 | 10/2003 |
| JP | A-2008-200780 | 9/2008 |
| JP | A-2009-072835 | 4/2009 |
| JP | A-2012-200847 | 10/2012 |
| WO | WO 2004/061041 A1 | 7/2004 |

* cited by examiner

CRUSH TIME

| GRAIN SIZE (MESH) | 60 | 80 | 100 | 120 | 140 | 170 | 200 | 230 | 270 | 325 | 400 | 500 | 600 | 800 | 1000 | 1200 |
|---|---|---|---|---|---|---|---|---|---|---|---|---|---|---|---|---|
| TIME (SECOND) | 30 | 45 | 60 | 75 | 90 | 105 | 120 | 150 | 180 | 210 | 240 | 270 | 300 | 330 | 360 | 390 |

FIG.10

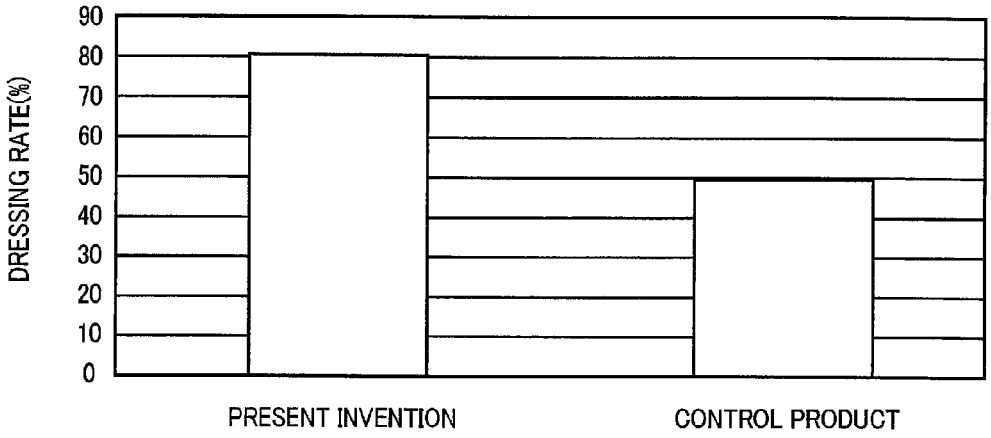

FIG.11

| SAMPLE NUMBER | SAMPLE 1 | SAMPLE 2 | SAMPLE 3 | SAMPLE 4 | SAMPLE 5 | SAMPLE 6 | SAMPLE 7 | SAMPLE 8 | SAMPLE 9 |
|---|---|---|---|---|---|---|---|---|---|
| DIAMOND AVERAGE GRAIN DIAMETER DIFFERENCE | 1.5 TIMES | 1 TIMES | 0.75 TIMES | 0.5 TIMES | 0.38 TIMES | 0.25 TIMES | 0.2 TIMES | 0.1 TIMES | 0.05 TIMES |
| RESULT | x | x | x | ○ | ◎ | ◎ | ○ | ○ | x |
| | DOMINATION RATE OF DIAMOND BECAME TOO HIGH AND THERE WAS NO EFFECT DUE TO DISPERSION PHENOMENON | DOMINATION RATE OF DIAMOND BECAME TOO HIGH AND THERE WAS NO EFFECT DUE TO DISPERSION PHENOMENON | DOMINATION RATE OF DIAMOND BECAME HIGH AND SHAPE ACCURACY WAS POOR DUE TO LOWERED CLEAN-CUTTING QUALITY | GOOD | BEST | BEST | GOOD | GOOD | DIAMOND WAS HIDDEN IN BOND AND DID NOT FUNCTION |

FIG.12

| SAMPLE NUMBER | SAMPLE 10 | SAMPLE 11 | SAMPLE 12 | SAMPLE 13 | SAMPLE 14 | SAMPLE 15 | SAMPLE 16 | SAMPLE 17 | SAMPLE 18 |
|---|---|---|---|---|---|---|---|---|---|
| RATIO OF DIAMOND (VOLUME %) | 1.5% | 2.75% | 3% | 5% | 7% | 9% | 12% | 13% | 14% |
| RESULT | × | △ | ○ | ○ | ◎ | ◎ | ○ | ○ | × |
| | NO EFFECT DUE TO DECREASE OF AUXILIARY ABRASIVE GRAIN | LITTLE EFFECT DUE TO DECREASE OF AUXILIARY ABRASIVE GRAIN | GOOD | GOOD | BEST | BEST | GOOD | GOOD | THERE WERE TOO MANY AUXILIARY ABRASIVE GRAINS AND SHAPE ACCURACY WAS POOR DUE TO LOWERED CLEAN-CUTTING QUALITY |

FIG.13

| SAMPLE NUMBER | SAMPLE 19 | SAMPLE 20 | SAMPLE 21 | SAMPLE 22 | SAMPLE 23 | SAMPLE 24 | SAMPLE 25 | SAMPLE 26 | SAMPLE 27 | SAMPLE 28 |
|---|---|---|---|---|---|---|---|---|---|---|
| RATIO OF BOND (VOLUME %) | 14% | 16% | 15% | 18% | 21% | 24% | 27% | 30% | 31% | 33% |
| RESULT | × | △ | ○ | ○ | ◎ | ◎ | ○ | ○ | × | × |
| | PROTRUDING AMOUNT BECAME 70% OR MORE AND AUXILIARY ABRASIVE GRAIN COULD NOT BE HELD | PROTRUDING AMOUNT BECAME 60% OR MORE AND ABRASIVE GRAIN HOLDING WAS UNSTEADY | GOOD | GOOD | BEST | BEST | GOOD | GOOD | PROTRUDING AMOUNT BECAME 20% OR LESS AND THERE WAS NO EFFECT OF HEAT ABSORPTION BY AUXILIARY ABRASIVE GRAIN | PROTRUDING AMOUNT BECAME 10% OR LESS AND THERE WAS NO EFFECT OF HEAT ABSORPTION BY AUXILIARY ABRASIVE GRAIN |

FIG.14

| SAMPLE NUMBER | SAMPLE 29 | SAMPLE 30 | SAMPLE 31 | SAMPLE 32 | SAMPLE 33 | SAMPLE 34 | SAMPLE 35 | SAMPLE 36 |
|---|---|---|---|---|---|---|---|---|
| DIAMOND TOUGHNESS VALUE DIFFERENCE | 0.2 | 0.3 | 0.4 | 0.6 | 0.8 | 0.9 | 1 | 1.1 |
| RESULT | x | x | O | ◎ | ◎ | O | O | x |
| | INCREASE OF WEAR DUE TO DIAMOND OF GOOD DESTRUCTIBILITY | INCREASE OF WEAR DUE TO DIAMOND OF GOOD DESTRUCTIBILITY | GOOD | BEST | BEST | GOOD | GOOD | DECREASE OF DRESSING RATE DUE TO TOUGH DIAMOND |

FIG.15

| SAMPLE NUMBER | SAMPLE 37 | SAMPLE 38 | SAMPLE 39 | SAMPLE 40 | SAMPLE 41 | SAMPLE 42 | SAMPLE 43 | SAMPLE 44 |
|---|---|---|---|---|---|---|---|---|
| CONTACT ANGLE OF BOND RELATIVE TO DIAMOND | 70° | 80° | 90° | 110° | 130° | 140° | 150° | 160° |
| RESULT | x | x | O | ◎ | ◎ | O | O | x |
| | DIAMOND WAS HIDDEN IN BOND AND DID NOT FUNCTION | | GOOD | BEST | BEST | GOOD | GOOD | BOND WETTABILITY WAS POOR AND THERE WAS NO EFFECT DUE TO DROPOUT OF DIAMOND |

VITRIFIED SUPER-ABRASIVE-GRAIN GRINDSTONE

TECHNICAL FIELD

The present invention relates to a vitrified grinding stone formed by bonding superabrasive grains, using a vitrified bond and in particular, relates to a technology of suppressing occurrence of deformation, lowered hardness, and residual stress of a work material caused by a grinding heat.

BACKGROUND ART

A vitrified superabrasive grain grinding stone, because of bonding of superabrasive grains by melting down an inorganic vitrified bond at calcination temperature in the order of, for example, 500 to 1000° C., can have a high abrasive grain holding power, namely, a high adhesive power between the superabrasive grains and the vitrified bond, as compared with the case of using an organic resin bond. For example, in the case of CBN abrasive grain, it is considered that, since B element, and K or Na element, etc., within a catalyst, added during a synthesis process thereof, are present on a surface thereof, these elements react with the vitrified bond and their chemical bonding power heightens the abrasive grain holding power.

Conventionally, out of steel-made work materials, a shaft component such as a camshaft and a crankshaft as a main component of an automobile engine is subjected to a high-precision grinding process for enhancement of performance of the engine but there have been problems of processing deformation, lowered hardness, and residual stress caused to the shaft component as the work material by a grinding heat generated at the time of grinding. As to a general countermeasure to eliminate the occurrence of these problems, proposals are made such as (a) using a clean-cutting grinding stone, (b) reducing an amount of cutting at grinding time, using a porous grinding stone, (c) lessening processing conditions by using a soft grinding stone of a low binding degree, (d) cooling by a sufficient supply of a coolant to a grinding point, and (e) using a grind stone with the CBN abrasive grain and a diamond abrasive grain mixed at various ratios. Such grinding stones are those described, for example, in Patent Document 1, Patent Document 2, and Patent Document 3.

PRIOR ART DOCUMENT

Patent Documents

Patent Document 1: Japanese Laid-Open Patent Publication No. 2009-072835

Patent Document 2: Japanese Laid-Open Patent Publication No. 2003-300165

Patent Document 3: Japanese Laid-Open Patent Publication No. 2000-158347

Patent Document 4: Japanese Laid-Open Patent Publication No. 2008-200780

SUMMARY OF THE INVENTION

Problem to be Solved by the Invention

The grinding stones proposed in Patent Documents 1 to 3 are all designed to be less prone to cause the grinding heat at the time of grinding and therefore, are effective against grinding burn. All of these proposals, however, are qualitative and many man-hours are required for building-in of optimum conditions enabling high quality and high efficiency every time product specifications and production efficiency, i.e., grinding efficiency, change. For this reason, there has been a problem that, when the product specifications and the production efficiency, i.e., grinding efficiency, change, a structural limitation occurs and this has a great effect on quality of the work material, starting with processing accuracy and life of the grinding stone. The grinding stone proposed in Patent Document 4 has no finding at all with respect to the residual stress of the material to be processed.

In contrast, the present applicant made a proposal of suppressing generation of the grinding heat, the deformation of the material to be processed, and the wear of a wheel and lengthening the life of the wheel by using the CBN abrasive grain as a main abrasive grain as well as using the diamond abrasive grain of high thermal conductivity as an auxiliary grain. This proposal is Japanese Patent Application No. 2011-070354 as a prior application not known to the public. This has left the problems of an increase in processing resistance and lowering of dressing performance unsettled.

The present invention is conceived in light of the above circumstances and the object thereof is to provide a vitrified superabrasive grain grinding stone capable of not only suppressing generation of grinding heat, deformation of material to be processed, and wear of a wheel but also obtaining lowered processing resistance and enhanced dressing performance.

As a result of various studies on suppressing of the grinding heat by heightening the thermal conductivity of the vitrified superabrasive grain grinding stone in the context of the above circumstances, the present inventors, etc., when focusing on the high thermal conductivity of a diamond grain conventionally considered to be unsuitable for the grinding of the steel-made work material and mixing the diamond grain, at a predetermined ratio, into the vitrified superabrasive grain grinding stone with the CBN abrasive grain used as its main abrasive grain, have found out the fact that generation of the grinding heat is decreased and the residual stress becomes smaller than before while high-precision and high-efficiency grinding performance is maintained. At the same time, it has been found out that when the toughness value of the diamond abrasive grain used as the auxiliary grain is set at 0.4 to 1 when that of the CBN abrasive grain as the main abrasive grain is given as 1, the diamond grain becomes the auxiliary grain having optimum destructibility despite high Knoop hardness and can preferably suppress the increase of the processing resistance and the lowering of the dressing performance. The present invention is conceived based on this finding.

Means for Solving the Problem

Namely, the present invention provides (a) a vitrified superabrasive grain grinding stone with superabrasive grains comprising a CBN abrasive grain as a main abrasive grain and a diamond abrasive grain as an auxiliary abrasive grain bonded together by use of a vitrified bond, wherein (b) the auxiliary abrasive grain has an average grain diameter equal to ½ to 1/10 of that of the main abrasive grain, and wherein (c) the auxiliary abrasive grain has a toughness value of 0.4 to 1 when that of the main abrasive grain is given as 1.

Effects of the Invention

According to the vitrified superabrasive grain grinding stone of the present invention, since the superabrasive grains comprise a CBN abrasive grain as a main abrasive grain and a diamond abrasive grain as an auxiliary abrasive grain, and the auxiliary abrasive grain has an average grain diameter equal to ½ to 1/10 of that of the main abrasive grain, abrasive grain dispersibility of the CBN is heightened by the average grain diameter of the auxiliary abrasive grain and at the same time, by a presence of the diamond abrasive grain having the thermal conductivity in the order of 2 times of that of CBN abrasive grain and in the order of 20 times of that of the alumina abrasive grain used as the filler, the grinding heat is efficiently absorbed and the residual stress of the work material is made smaller. Since the auxiliary abrasive grain has the toughness value of 0.4 to 1 when that of the main abrasive grain is given as 1 and has optimum destructibility despite high Knoop hardness, an increased processing resistance and a lowered dressing performance are suppressed, lengthening a durability life of the grinding wheel.

Preferably, a contact angle of the auxiliary abrasive grain with the vitrified bond is 90 to 150°. Consequently, since the auxiliary abrasive grain is held by the vitrified bond without being embedded in the vitrified bond, a heat absorption effect by the auxiliary abrasive grain is maintained and at the same time, a dropout of the auxiliary abrasive grain is preferably prevented. If the contact angle of the vitrified bond relative to the auxiliary abrasive grain is less than 90°, then the auxiliary abrasive grain is embedded in the vitrified bond and the heat absorption effect by the auxiliary abrasive grain is lowered. On the contrary, if the contact angle of the vitrified bond relative to the auxiliary abrasive grain is more than 150°, then a holding power of the auxiliary abrasive grain is lowered, resulting in many dropouts.

Preferably, the auxiliary abrasive grain is contained at a volume ratio of 3 to 13 volume %. Consequently, this makes it possible to preferably obtain the heat absorption effect due to the high thermal conductivity of a diamond used as an auxiliary abrasive grain and the effect of suppressing the increased processing resistance and the lowered dressing performance due to the optimum destructibility despite the high Knoop hardness of the auxiliary abrasive grain. If the volume ratio of the auxiliary abrasive grain is less than 3 vol. %, then the heat absorption effect, and the effect of suppressing the processing resistance and the lowered dressing performance, coming from the diamond become hard to obtain and if the volume ratio of the auxiliary abrasive grain is more than 13 vol. %, then the clean-cutting quality, the grinding processing accuracy, and the dressing performance are lowered.

Preferably, since the vitrified bond is contained at a volume ratio of 15 to 30 volume %, the effect coming from the presence of the diamond abrasive grain can be obtained. If the volume ratio of the vitrified bond is less than 15 vol. %, then the ratio of the diamond abrasive grain exposing itself on the surface of the vitrified bond becomes high, a domination rate of the diamond abrasive grain contributing to the grinding relatively becomes high. As a result, the clean-cutting quality and a grinding accuracy are lowered. On the contrary, if the volume ratio of the vitrified bond is more than 30 vol. %, then the diamond abrasive grain is embedded in the vitrified bond, a function by the diamond abrasive grain is lowered, and an effect coming from the presence thereof cannot be sufficiently obtained.

Preferably, the vitrified superabrasive grain grinding stone comprises: a core having a cylindrical outer peripheral surface; and a plurality of segment grinding stones attached on the outer peripheral surface of the core, and the segment grinding stones have the superabrasive grains bonded together by use of the vitrified bond at least in an outer peripheral side layer thereof. Accordingly, expensive superabrasive grains are arranged solely in an area involved in the grinding out of the vitrified superabrasive grain grinding stone and the inorganic filler such as the general abrasive grain can be used for other portion and therefore, the vitrified superabrasive grain grinding stone becomes inexpensive.

BRIEF DESCRIPTION OF THE DRAWINGS

FIG. 10 is a diagram for indicating a dressing rate of the vitrified grinding stone strip of the product of the present invention as contrasted with a dressing rate of a grinding using a vitrified grinding stone strip of the control product in the grinding performance evaluation test 1.

FIG. 11 is a chart of a grinding result when 9 kinds of samples with the average grain diameter of the diamond abrasive grain of the vitrified grinding stone strip that is the product of the present invention varied are used in the grinding performance evaluation test 2.

FIG. 12 is a chart of a grinding result when 9 kinds of samples with the volume ratio of the diamond abrasive grain of the vitrified grinding stone strip that is the product of the present invention varied are used in the grinding performance evaluation test 3.

FIG. 13 is a chart of a grinding result when 10 kinds of samples with the volume ratio of a vitrified bond of the vitrified grinding stone strip that is the product of the present invention varied are used in the grinding performance evaluation test 4.

FIG. 14 is a chart of a grinding result when 8 kinds of samples with the toughness value of the diamond abrasive grain of the vitrified grinding stone strip that is the product of the present invention varied are used in the grinding performance evaluation test 5.

FIG. 15 is a chart of a grinding result when 8 kinds of samples with a contact angle of the vitrified bond of the vitrified grinding stone strip that is the product of the present invention varied are used in the grinding performance evaluation test 6.

MODE(S) FOR CARRYING OUT THE INVENTION

An embodiment of the present invention will be described in detail with reference to the drawings. In the following embodiment, the drawings are simplified or deformed appropriately and are not necessarily accurately drawn in the dimensional ratio, the shape, etc. of portions.

Embodiment

Figure 1:
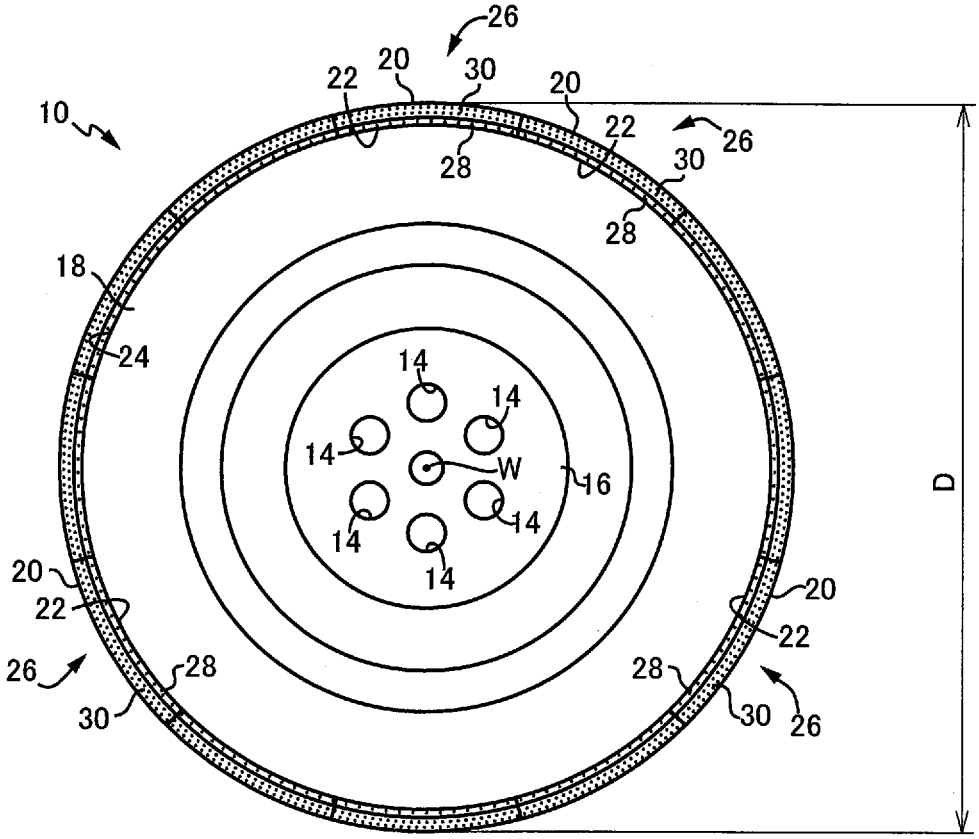
FIG. 1 is a front view of a superabrasive grain grinding wheel manufactured through a manufacturing method of this embodiment.

FIG. 1 is a front view of a superabrasive grain grinding wheel 10 manufactured through a manufacturing method according to an embodiment of the present invention. The superabrasive grain grinding wheel 10 has a core, namely, a base metal 18 that is of a shape of a disc made of metal such as, for example, carbon steel and aluminum alloy and has at its central part a mounting portion 16 having mounting holes 14 for mounting to a grinding device (e.g., a cylindrical grinding machine 12 to be described later) and plural pieces (12 pieces in this embodiment) of a vitrified grinding stone strip (segment grinding stone) 26 that is circular-arc-plate-shaped, curved along an arc having an axis of rotation W of the base metal 18 as its curvature center, has a grinding surface 20 on its outer peripheral surface and an adhesive surface 22 on an inner peripheral surface on a side opposite thereto, and has the adhesive surface 22 caused to stick tightly to an outer peripheral surface 24 of the base metal 18. While a size thereof is appropriately set depending on an application, the superabrasive grain grinding wheel 10 of this embodiment is configured to have the dimension in the order of 380 mm ϕ in outer diameter D and 10 mm in thickness excluding the mounting portion 16.

Figure 2:
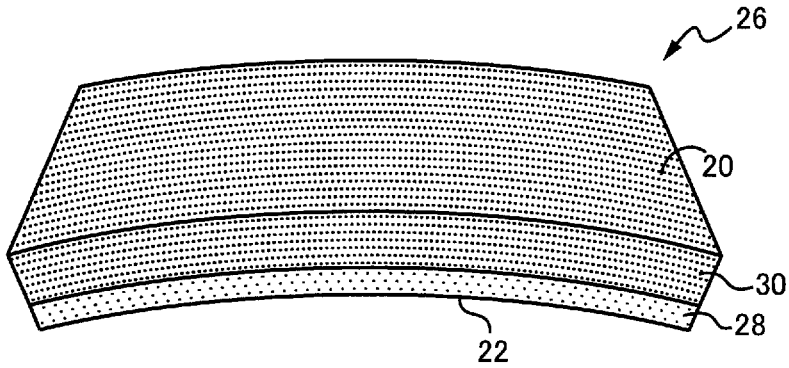
FIG. 2 is a perspective view of a vitrified grinding stone strip of FIG. 1.
Figure 3:
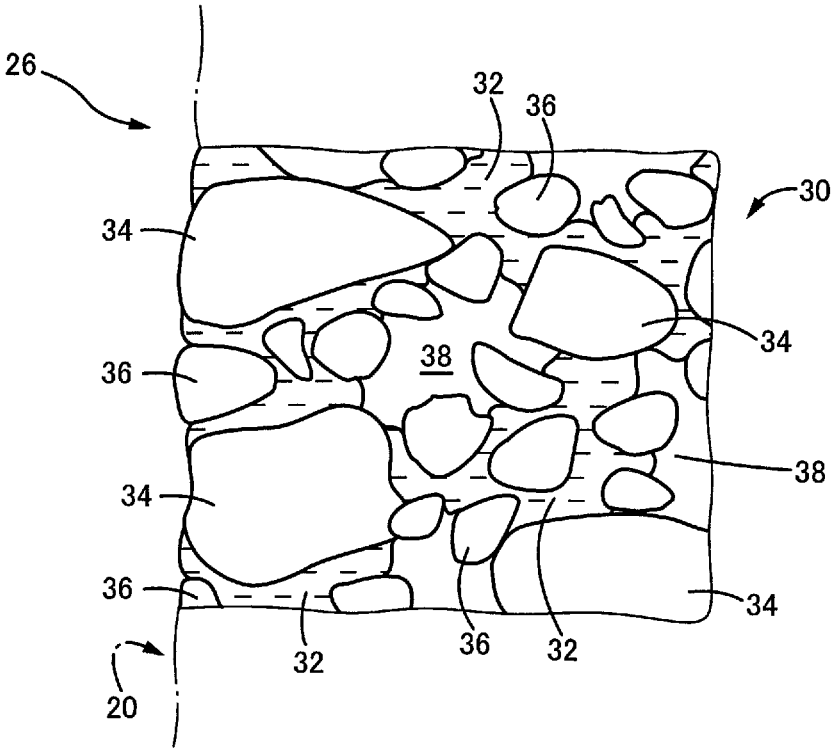
FIG. 3 is a diagram for description of an enlarged structure of a surface layer of the vitrified grinding stone strip of FIG. 2.

FIG. 2 is a perspective view of the vitrified grinding stone strip 26. FIG. 3 is an example of a schematic diagram of an enlarged cross section of a surface layer 30 composed of a vitrified superabrasive grain grinding stone structure and is a schematic diagram for description of an internal condition of bonding of a vitrified bond 32 with a CBN abrasive grain 34 and a diamond abrasive grain 36. In FIGS. 1 to 3, the vitrified grinding stone strip 26 is integrally configured by an inner peripheral side layer, i.e., a base layer 28, formed by bonding a general abrasive grain or inorganic filler of ceramic such as fused alumina, carborundum, and mullite by the glassy vitrified bond 32 and an outer peripheral side layer, i.e., the surface layer 30, formed by bonding the CBN abrasive grain 34 and the diamond abrasive grain 36 of a smaller diameter than that of the CBN abrasive grain 34 by a glassy inorganic bonding agent. The base layer 28 functions solely as a base to mechanically support the surface layer 30.

The surface layer 30 functions solely as a grinding stone to grind a work material 104 to be described later and includes the CBN abrasive grain 34 functioning as a main abrasive grain, the diamond abrasive grain 36 functioning as an auxiliary abrasive grain or a filler, and a pore 38. The CBN abrasive grain 34 is a cubic boron nitride particle and has, for example, the Knoop hardness in the order of 4700 kg/mm$^2$ and the toughness value in the order of 55, and the CBN abrasive grain 34 of the size within a range of, for example, 60 mesh (average particle diameter of 250 μm) to 3200 mesh (average particle diameter of 5 μm) is preferably used.

The diamond abrasive grain 36 has a diameter smaller than that of the CBN abrasive grain 34 and has the Knoop hardness higher than that of the CBN abrasive grain 34, the Knoop hardness in the order of, for example, 6000 kg/mm$^2$ and the toughness value equal to or smaller than that of the CBN abrasive grain 34, the toughness value in the order of, for example, 33. The diamond abrasive grain 36, while functioning as an abrasive grain to a certain extent, functions as a thermal conductor of grinding heat as well as having a function of exposing itself on the grinding surface 20 to suppress grinding stone wear. To have this function efficiently generated, the diamond abrasive grain 36 has an average grain diameter equal to, for example, ½ to 1/10 of that of the CBN abrasive grain 34 and is mixed to have the volume ratio of, for example, 3 to 13 vol. %. Namely, in the surface layer 30, for example, the volume ratio of the CBN abrasive grain 34 is 30 to 40 vol. %, the volume ratio of the diamond abrasive grain 36 is 3 to 13 vol. %, the volume ratio of the vitrified bond 32 is 20 to 30 vol. %, and the volume ratio of the remaining pore 38 is 17 to 47 vol. %.

The vitrified bond 32 is preferably configured by, for example, borosilicate glass or crystallized glass. As for the crystallized glass, there is such one as is precipitated, for example, from willemite. Sufficient abrasive grain holding power is considered to be, preferably, $\pm 2\times10^{-6}$(1/K) (room temperature to 500° C.) with respect to the CBN abrasive grain 34. Glass composition desirable as the vitrified bond 32 is, for example, as follows. $SiO_2$: 40 to 70 wt. part, $Al_2O_3$: 10-20 wt. part, $B_2O_3$: 10 to 20 wt. part, RO (alkali earth metal): 20 to 10 wt. part, $R_2O$: 2 to 10 wt. part In FIG. 3, inside the vitrified bond 32 and on a surface thereof, the diamond abrasive grain 36 is dispersed that has the diameter smaller than that of the CBN abrasive grain 34. The diamond abrasive grain 36 has relatively lower wettability with the vitrified bond 32 than that of the general abrasive grain such as an alumina abrasive grain (Alundum Wash.) and the CBN abrasive grain 34, is hard to cover by the vitrified bond 32, and tends to expose itself on the surface of the vitrified bond 32 and a surface of the surface layer 30, i.e., a surface of the grinding stone. For this reason, grinding heat generated at a grinding point between the work material 104 and the grinding surface 20 of the surface layer 30 can efficiently be absorbed by the metal-made base metal 18 by way of the diamond abrasive grain 36 of high thermal conductivity.

Figure 4:
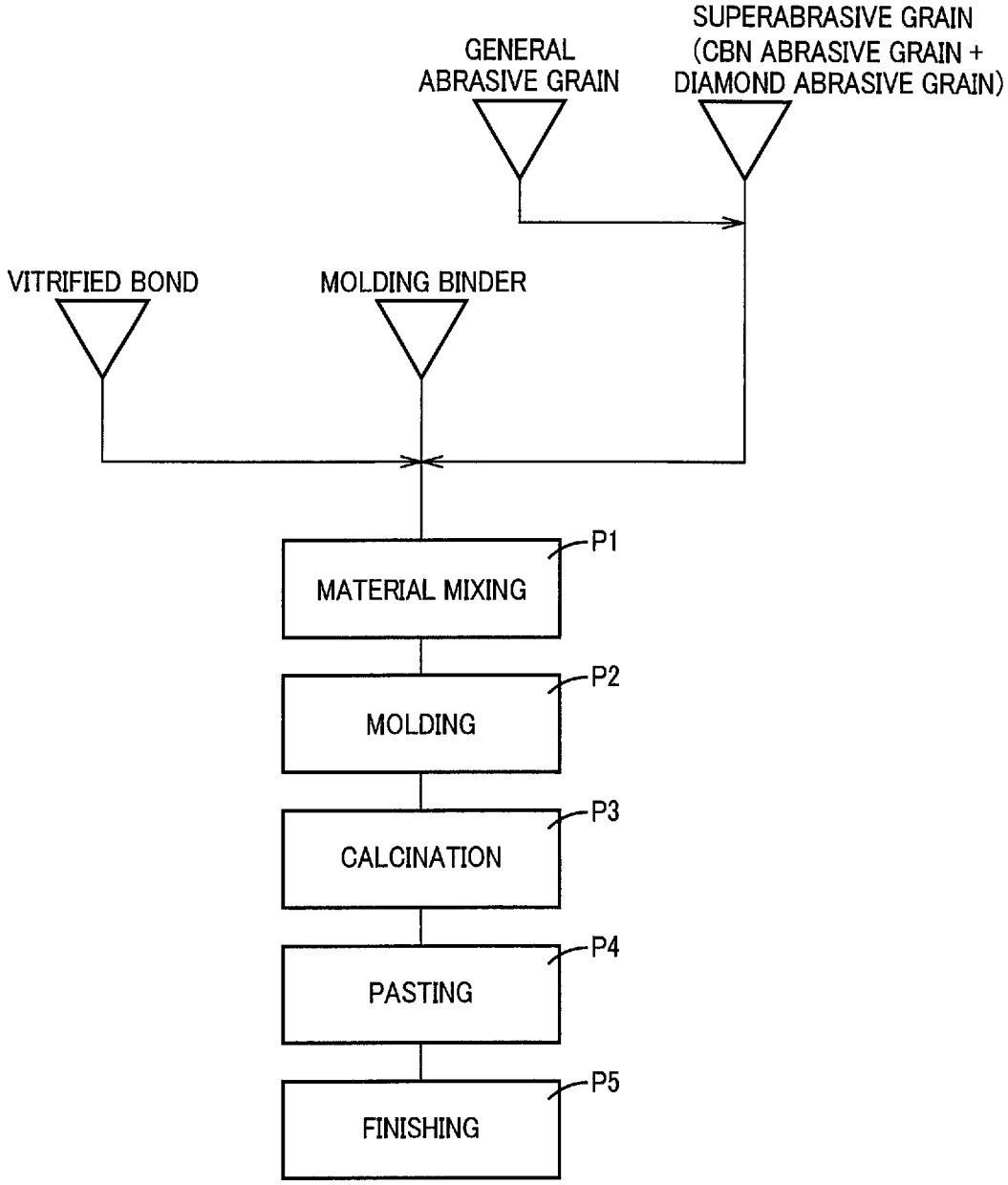
FIG. 4 is a process chart for description of a main part of the manufacturing method of the vitrified superabrasive grain grinding stone.

FIG. 4 is a process chart for description of a main part of an example of the manufacturing method of the superabrasive grain grinding wheel 10. In FIG. 4, in a material mixing process P1, prepare materials shown in Table 2 for the base layer 28 making up the vitrified grinding stone strip 26 and materials shown in Table 1 for the surface layer 30 making up the vitrified grinding stone strip 26. Namely, weigh, at the ratio pre-set for the base layer 28, the general abrasive grain such as $Al_2O_3$ system known as the alumina abrasive grain, the glassy vitrified bond (inorganic bonding agent) such as $ZrO_2$—$B_2O_3$ system, $B_2O_3$—$Al_2O_3$—$SiO_2$ system, and LiO—$Al_2O_3$—$SiO_2$ system, and a molding binder (binding agent or thickener) such as dextrin to generate a certain degree of mutual binding power at the time of molding, mix these materials, and prepare the material of Table 2 for the base layer 28. Weigh, at the ratio pre-set for the surface layer 30, the CBN abrasive grain 34, the diamond abrasive grain 36, the vitrified bond 32, a pore forming agent such as organic substances or inorganic balloons to be appropriately mixed as necessary, and the molding binder (binding agent or thickener) such as dextrin to generate a certain degree of mutual binding power at the time of molding, mix these materials, and prepare the material of Table 1 for the surface layer 30.

TABLE 1

| Name of Raw Material | Ratio |
|---|---|
| CBN abrasive grain (#100/120) | 40 volume part |
| Diamond abrasive grain (#700/800) | 5 volume part |
| Vitrified bond | 20 volume part |
| Thickener | 6 volume part |

TABLE 2

| Name of Raw Material | Ratio |
|---|---|
| Spherical mullite | 35 volume part |
| Electrically-melted mullite | 14 volume part |
| Vitrified bond | 20 volume part |
| Thickener | 6 volume part |

Figures 5, 6:
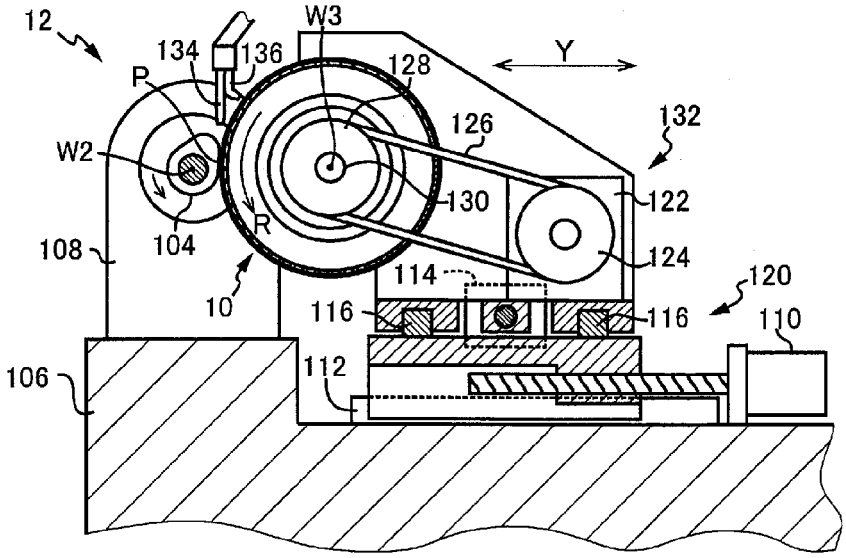
FIG. 5 is a diagram for indicating a crush time changed depending on a grain size used for a measurement of a toughness value of a diamond abrasive grain used in the superabrasive grain grinding wheel of FIG. 1.
FIG. 6 is a diagram of an example of a usage situation of the superabrasive grain grinding wheel of FIG. 1 and is a side view indicated by cutting out a main part of the superabrasive grain grinding wheel in a state in which a camshaft that is work material is ground by a cylindrical grinding machine to which the vitrified superabrasive grain grinding stone is mounted.

The diamond abrasive grain 36 is used that has the toughness value of 0.4 to 1 when that of the CBN abrasive grain 34 is given as 1. When, after 0.4 g of a sample sieved by a sieve net specified by grain size (sieve having the highest remaining rate in ISO6106:2005) and one steel ball of 2.040 g are put in a cylindrical metal tube of 12.5 mm diameter and 19 mm length and are crushed at 2400 rpm and 8 mm amplitude for a crush time specified depending on grain size as shown in FIG. 5, the sample is sieved by the specified sieve net (having the highest remaining rate in a grain size distribution specification finer by one grain size in ISO6106:2005; however, as to #400, same sieve as with #325), what is expressed by weight percentage of the remnant on the sieve net is the toughness value mentioned above. The apparatus and the method to be used in connection with this sieving shall comply with JIS B4130. In the case of grain size finer than #400, sample 10% grain diameter is measured and, after crushing by the crushing method described above, what is expressed by the remaining percentage of the volume of grain with the diameter larger than the pre-measured 10% grain diameter is the toughness value. The 10% grain diameter indicates the grain diameter at 10% in the integrated value from grain size distribution obtained by a laser diffraction/scattering method. From the thus measured toughness value of the CBN abrasive grain 34 and of the diamond abrasive grain 36, the ratio of the toughness value of the diamond abrasive grain 36 to the CBN abrasive grain 34 (diamond abrasive grain 36 toughness value/CBN abrasive grain 34 toughness value) is calculated.

Then, in a molding process P2, a molded body of the shape shown in FIG. 2 is molded by sequentially filling the mixed materials for the surface layer 30 and the mixed materials for the base layer 28 into a molding cavity of a predetermined molding die and applying pressure thereto. Then, in a calcination process P3, with the molded body calcined, for example, at 1000° C. or below for five hours, the vitrified grinding stone strip 26, for example, of 40 mm length, 10.4 mm width, and 7.4 mm thickness is manufactured. By the above calcination, the organic substances such as the binding agent included in the materials are caused to disappear and the inorganic bonding agent is caused to melt and thereafter, the abrasive grains are bonded to one another by a solidified inorganic bonding agent. By this, a porous vitrified grinding stone structure with a large number of continuous pores, in which the superabrasive grains are bonded by the inorganic bonding agent, is formed in the manufactured vitrified grinding stone strip 26.

Then, in a pasting process P4, the vitrified grinding stone strip 26 is attached tightly on the cylindrical outer peripheral surface 24 of the pre-manufactured base metal 18, using, for example, epoxy resin adhesive agent, etc. Then, in a finishing process P5, a surface of the base metal 18 with the vitrified grinding stone strip 26 attached thereto, namely, the superabrasive grain grinding wheel 10, is adjusted in respect of the outer diameter dimension D, the roundness of the outer diameter dimension D, the thickness dimension, etc., of the superabrasive grain grinding wheel 10, using a dressing tool and a cutting tool. The vitrified grinding stone strip 26 is manufactured to have predetermined dimensions that are larger by the above grinding tolerances at the time of finishing the calcination process P3. By undergoing the above processes, the superabrasive grain grinding wheel 10 is manufactured in which the vitrified grinding stone strip 26 having the superabrasive grains bonded by the inorganic bonding agent is attached on the outer peripheral surface 24 of the base metal 18, as shown in FIG. 1.

FIG. 6 is a diagram of an example of a usage situation of the manufactured superabrasive grain grinding wheel 10 and is a side view of a state in which a cam surface as an outer peripheral surface of the steel-made work material (camshaft) 104 is ground by the cylindrical grinding machine 12 to which the superabrasive grain grinding wheel 10 is mounted. In FIG. 6, the cylindrical grinding machine 12 has a bed 106 as a base, a headstock 108 disposed on the bed 106 and having a main shaft that holds the elliptic-type, cam-shaped work material 104 between itself and a tailstock spindle of a tailstock, not shown, and rotatively drives the work material 104 around a shaft center W2 perpendicular to a paper plane, a table 120 movable by a servo motor 110, in a direction parallel with the shaft center W2, along a pair of rails 112 and movable by a servo motor 114, in a direction Y perpendicular to the shaft center W2, along a pair of rails 116, a grinding wheel base 132 disposed on the table 120 and having a rotary main shaft 130 that is rotatively driven by a motor 122, around a shaft center W3 perpendicular to the paper plane, by way of a pulley 124, a belt 126, and a pulley 128, and a pair of nozzles 134 and 136 through which coolant (serving as grinding liquid as well) supplied by a pump, not shown, is sprayed with a predetermined pressure. The superabrasive grain grinding wheel 10 is fixed to the rotary main shaft 130, with its rotary shaft center W and the shaft center W3 matched. The grinding process by the cylindrical grinding machine 12 is so arranged that the work material 104 is ground by the grinding surface 20 of the rotating superabrasive grain grinding wheel 10, by the grinding wheel base 132 being shifted in the direction Y toward the work material 104, while the coolant is being supplied from one nozzle 134 to a grinding point P between the rotating superabrasive grain grinding wheel 10 and the work material 104 and at the same time, the coolant is being sprayed from the other nozzle 136 to the grinding surface 20 of the superabrasive grain grinding wheel 10. At that time, it is so arranged that the grinding surface 20 is cleaned by the coolant being sprayed by the nozzle 136 to the superabrasive grain grinding wheel 10 at a position away from the grinding point P in a direction opposite to a rotational direction R of the superabrasive grain grinding wheel 10.

The vitrified grinding stone strip (vitrified superabrasive grain grinding stone) 26 contains the CBN abrasive grain 34 as a main abrasive grain and the diamond abrasive grain 36 as an auxiliary abrasive grain, and the diamond abrasive grain 36 has the toughness value of 0.4 to 1 when that of the CBN abrasive grain 34 is given as 1, has an average grain diameter equal to ½ to 1/10 of that of the CBN abrasive grain 34, and is included at the volume ratio of 3 to 13 vol. %. From this, since the diamond abrasive grain 36 as an auxiliary abrasive grain has the average grain diameter equal to ½ to 1/10 of that of the CBN abrasive grain 34 as a main abrasive grain, dispersibility of the CBN abrasive grain 34 is heightened by the average grain diameter of the diamond abrasive grain 36 and at the same time, by a presence of the diamond abrasive grain 36 having the thermal conductivity in the order of 2 times of that of CBN abrasive grain 34 and in the order of 20 times of that of the alumina abrasive grain used as the filler, the grinding heat is efficiently absorbed by the vitrified grinding stone strip 26. Since the diamond abrasive grain 36 has the toughness value of 0.4 to 1 when that of the CBN abrasive grain 34 is given as 1 and has optimum destructibility despite high Knoop hardness, an increased processing resistance and a lowered dressing performance are suppressed of the superabrasive grain grinding wheel 10, lengthening a durability life of the superabrasive grain grinding wheel 10.

According to the vitrified grinding stone strip 26 of this embodiment, since the diamond abrasive grain 36 as an auxiliary abrasive grain, because of a contact angle of 90 to 150° with vitrified bond 32, is held by the vitrified bond 32, without being embedded in the vitrified bond 32, a heat absorption effect by the diamond abrasive grain 36 is maintained and at the same time, a dropout of the diamond abrasive grain 36 is preferably prevented. If the melting-time contact angle of the vitrified bond 32 relative to the diamond abrasive grain 36 is less than 90°, then the diamond abrasive grain 36 is embedded in the vitrified bond 32 and the heat absorption effect by the diamond abrasive grain 36 is lowered. On the contrary, if the melting-time contact angle of the vitrified bond 32 relative to the diamond abrasive grain 36 is more than 150°, then a holding power of the diamond abrasive grain 36 is lowered, resulting in many dropouts and absorption of the grinding heat by the diamond abrasive grain 36 becomes insufficient. In either case, the heat absorption effect of the grinding heat by the diamond abrasive grain 36 is lowered and therefore, the effect of suppressing the processing resistance and the lowered dressing performance becomes hard to obtain and clean-cutting quality, a grinding processing accuracy, and the dressing performance are lowered.

According to the vitrified grinding stone strip 26 of this embodiment, the diamond abrasive grain 36 as an auxiliary abrasive grain is contained at the volume ratio of 3 to 13 vol. %. This makes it possible to preferably obtain the heat absorption effect due to the high thermal conductivity of the diamond abrasive grain 36 and the effect of suppressing the increased processing resistance and the lowered dressing performance due to the optimum destructibility despite the high Knoop hardness of the diamond abrasive grain 36. If the volume ratio of the diamond abrasive grain 36 is less than 3 vol. %, then the heat absorption effect, and the effect of suppressing the processing resistance and the lowered dressing performance, coming from the diamond become hard to obtain and if the volume ratio of the diamond abrasive grain 36 is more than 13 vol. %, then the clean-cutting quality, the grinding processing accuracy, and the dressing performance are lowered.

According to the vitrified grinding stone strip 26 of this embodiment, since the vitrified bond 32 is contained at the volume ratio of 15 to 30 vol. %, the effect coming from the presence of the diamond abrasive grain 36 can be obtained. If the volume ratio of the vitrified bond 32 is less than 15 vol. %, then the ratio of the diamond abrasive grain 36 exposing itself on the surface becomes high, the holding of the diamond abrasive grain 36 becomes unsteady, and the clean-cutting quality and grinding efficiency are lowered. On the contrary, if the volume ratio of the vitrified bond 32 is more than 30 vol. %, then the diamond abrasive grain 36 is embedded in the vitrified bond 32, a heat absorption function by the diamond abrasive grain 36 is lowered, and the effect coming from the presence thereof cannot be sufficiently obtained.

According to the superabrasive grain grinding wheel 10 of this embodiment, since the superabrasive grain grinding wheel 10 has the core, i.e., base metal 18, having the cylindrical outer peripheral surface 24 and plural pieces of the vitrified grinding stone strip 26 attached on the outer peripheral surface of the base metal 18 and at least the surface layer 30 out of the vitrified grinding stone strip 26 has the CBN abrasive grain 34 and the diamond abrasive grain 36 bonded together by use of the vitrified bond 32, expensive superabrasive grains are arranged solely in an area involved in the grinding out of the vitrified grinding stone strip 26 and the inorganic filler such as the general abrasive grain can be used for other portion and therefore, the superabrasive grain grinding wheel 10 becomes inexpensive.

Evaluation tests 1 to 6 will now be described that were performed by the present inventors for evaluation of grinding performance of the superabrasive grain grinding wheel 10.

[Grinding Performance Evaluation Test 1]

In this evaluation test 1, a vitrified grinding stone composed of a control product described below and a vitrified grinding stone composed of a product of the present invention were prepared, basically from the following materials and at the following ratio, using the process shown in FIG. 4 and a grinding test and measurement were performed, using these grinding stones, under the following conditions. FIGS. 7 to 10 indicate results of this evaluation test 1.

<Control Product>

Main abrasive grain: CBN abrasive grain #120 (Knoop hardness 4700 kg/mm$^2$, thermal conductivity 1200 w/m·k, toughness value 55)

Auxiliary abrasive grain: diamond abrasive grain #500 (Knoop hardness 6000 kg/mm$^2$, thermal conductivity 2000 w/m·k, toughness value 62)

Volume ratio of main abrasive grain: 40%

Volume ratio of auxiliary abrasive grain: 9%

Bond ratio 26%

<Product of Present Invention>

Main abrasive grain: CBN abrasive grain #120 (Knoop hardness 4700 kg/mm$^2$, thermal conductivity 1200 w/m·k, toughness value 55)

Auxiliary abrasive grain: diamond abrasive grain #500 (Knoop hardness 6000 kg/mm$^2$, thermal conductivity 2000 w/m·k, toughness value 33)

Volume ratio of main abrasive grain: 40%

Volume ratio of auxiliary abrasive grain: 9%

Bond ratio 26%

<Grinding Test Condition>

Machining center: NTC cam profile grinding machine NTG-CMQII2060

Grinding stone size: 350 mmϕ×35 mmT×20 mmH

Work to be processed: FCD700 (camshaft)

Cut: 1 μm/one pass

Feed speed: 150 to 10 mm/min (4-step grinding)

Grinding liquid: NK-Z made by Noritake Company, Limited (30 times dilution)

Dressing: 120 mmϕ sharpener, 5 μm cut, lead 0.28 mm/rev

<Measurement Item>

Measurement of residual stress

Measuring device: X-ray stress measuring device (made by Rigaku Co., Ltd.)

Measuring location: cam lift portion

The residual stress (MPa) of a cam lift portion out of the cam surface of the work material was measured, using the X-ray stress measuring device AutoMATE made by Rigaku Co., Ltd., at a predetermined interval corresponding to an increase in the number of pieces processed.

Measurement of wheel radius wear amount

Measuring device: surface roughness meter (Taylor Hobson-made)

Measuring location: carbon pattern-taking, cross-sectional step measurement

A step (μm) in the direction of the rotating shaft center corresponding to the depth of a concave formed by being in slide contact with the camshaft at the grinding surface of the grinding stone used for the grinding test was measured, using the surface shape roughness measuring device PGI1250A made by Taylor Hobson, at a predetermined interval corresponding to an increase in the number of pieces processed.

Measurement of power consumption

Measuring device: a power meter (made by Hioki E. E. Corporation)

Measuring location: grinding stone shaft motor

Power consumption (kW) of the grinding stone shaft drive motor of the grinding machine during grinding was measured, using the power meter made by Hioki E. E. Corporation, at a predetermined interval corresponding to an increase in the number of pieces processed.

Measurement of dressing rate

Measuring device: contour shape measuring device (made by Mitutoyo Corporation)

Measuring location: dressing surface of a rotary dresser

The outer diameter of the rotary dresser before and after the dressing of the outer peripheral surface of the vitrified grinding stone was measured, using the contour shape measuring device CV-2000 made by Mitutoyo Corporation, to obtain the wear amount by the dressing and at the same time, the ratio of the wheel radius wear amount (step μm) to the wear amount by the dressing, namely, the dressing rate (%), was calculated for each grinding.

Figure 7:
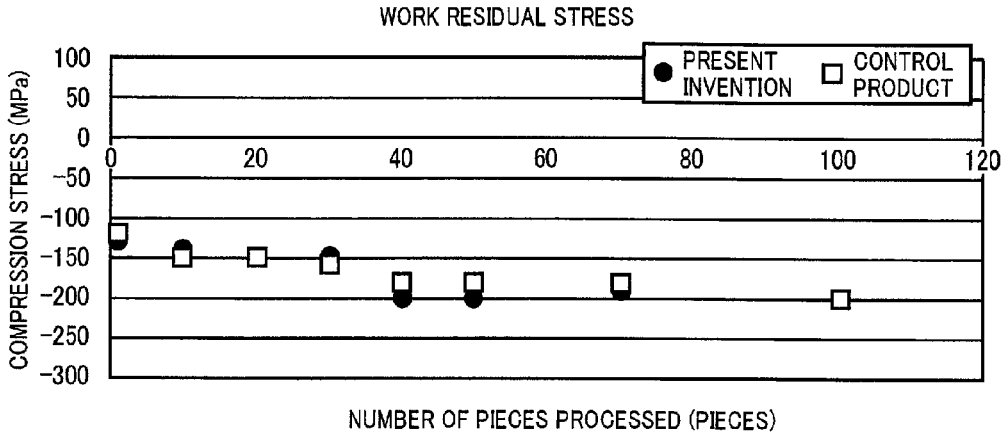
FIG. 7 is a diagram for indicating a change in the number of pieces processed while contrasting work residual stress by a grinding using a vitrified grinding stone strip of the product of the present invention with work residual stress by a grinding using a vitrified grinding stone strip of the control product in the grinding performance evaluation test 1.

FIG. 7 shows measured values of the work residual stress (MPa) of the work material ground under the above grinding conditions, for each number of pieces processed by grinding. No difference is shown by FIG. 7 between the value (marked by black circle) of the vitrified grinding stone of the product of the present invention and the value (marked by square) of the vitrified grinding stone of the control product. In both of the two, compression stress of the surface is heightened and a wear resistance is enhanced.

Figure 8:
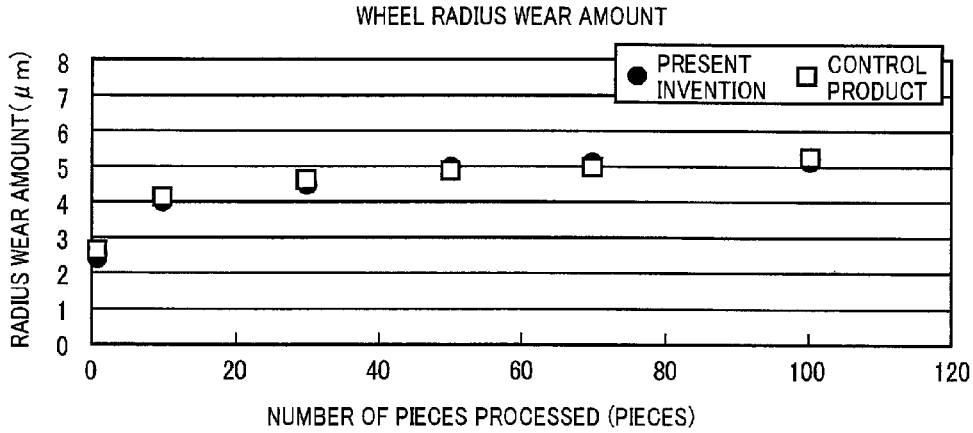
FIG. 8 is a diagram for indicating a change in the number of pieces processed while contrasting a wheel radius wear amount by a grinding using a vitrified grinding stone strip of the product of the present invention with a wheel radius wear amount by a grinding using a vitrified grinding stone strip of the control product in the grinding performance evaluation test 1.

FIG. 8 shows measured values of the wear amount (μm) in the direction of the wheel radius for each number of pieces processed. No difference is seen between the value (marked by black circle) of the vitrified grinding stone of the product of the present invention and the value (marked by square) of the vitrified grinding stone of the control product. In both of the two, the wear amount in the wheel radius direction is small and the wear resistance is enhanced.

Figure 9:
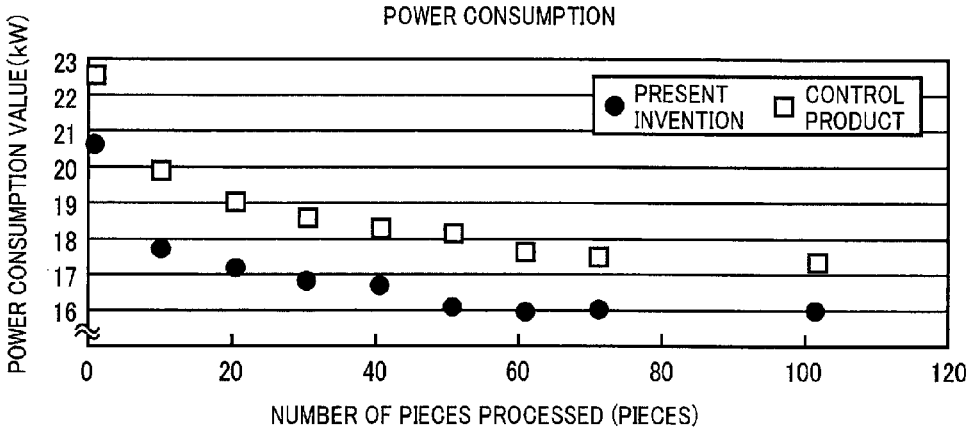
FIG. 9 is a diagram for indicating a change in the number of pieces processed while contrasting a value of power consumption in a grinding using a vitrified grinding stone strip of the product of the present invention with a value of power consumption in a grinding using a vitrified grinding stone strip of the control product in the grinding performance evaluation test 1.

FIG. 9 shows measured values of power consumption (kW) during grinding for each number of pieces processed. The value (marked by black circle) of the vitrified grinding stone of the product of the present invention is smaller, in the order of 10%, than the value (marked by square) of the vitrified grinding stone of the control product. The vitrified grinding stone of the product of the present invention has a lower rotation resistance during grinding than that of the vitrified grinding stone of the control product and has a considerably enhanced clean-cutting quality of the vitrified grinding stone.

FIG. 10 shows the dressing rate at the time of dressing of the vitrified grinding stone of the product of the present invention as contrasted with the dressing rate at the time of dressing of the vitrified grinding stone of the control product, when the dressing is performed by a certain (5 μm) cut. The dressing rate of the vitrified grinding stone of the product of the present invention was 80% (80% cut of the vitrified grinding stone was obtained in contrast with 20% wear of the dresser), while the dressing rate was 50% at the time of dressing of the vitrified grinding stone of the control product. According to the vitrified grinding stone of the product of the present invention, dresser wear at the time of dressing was small and dressing quality is considerably enhanced.

[Grinding Performance Evaluation Test 2]

In grinding performance evaluation test 2, under the conditions of same composition and vol. % as those of the vitrified grinding stone of the product of the present invention used in grinding performance evaluation test 1, 9 kinds of samples 1 to 9 were prepared by varying the ratio of the average grain diameter of the diamond abrasive grain to that of the CBN abrasive grain and the same grinding test as described above was performed, using these samples 1 to 9. FIG. 11 shows results thereof. As shown in FIG. 11, the results of the grinding by sample 4, sample 5, sample 6, sample 7, and sample 8 in which the average grain diameter of the diamond abrasive grain was 0.5 times, 0.38 times, 0.25 times, 0.2 times, and 0.1 times, respectively, with regard to that of the CBN abrasive grain indicated satisfactory performance as a grinding stone product. In the grinding by sample 1, sample 2, and sample 3 in which the average grain diameter of the diamond abrasive grain was 1.5 times, 1 times, and 0.75 times, respectively, with regard to that of the CBN abrasive grain, however, a domination rate of the diamond abrasive grain contributing to the grinding was too high, the clean-cutting quality had a declining tendency, and sufficient shape accuracy was not obtained. On the contrary, in the grinding by sample 9 in which the average grain diameter of the diamond abrasive grain was 0.05 times with regard to that of the CBN abrasive grain, since the diamond abrasive grain was too small and could not sufficiently contribute to thermal conduction and suppression of the wear, the thermal conduction of the grinding heat and the suppression of the wear could not be obtained sufficiently and sample 9 was insufficient in respect of the residual stress and the wear. Therefore, with respect to the average grain diameter of the diamond abrasive grain, preferable results were obtained in a range in which the average grain diameter of the diamond abrasive grain was 0.5 to 0.1 times with regard to that of the CBN abrasive grain.

[Grinding Performance Evaluation Test 3]

In grinding performance evaluation test 3, samples 10 to 18 were prepared, with the same composition as that of the vitrified grinding stone of the product of the present invention used in grinding performance evaluation test 1, but with only the volume % of the diamond abrasive grain varied, and the same grinding test as described above was performed. FIG. 12 shows results thereof. As shown in FIG. 12, results of the grinding by sample 12, sample 13, sample 14, sample 15, sample 16, and sample 17 in which the volume % of the diamond abrasive grain was 3 vol. %, 5 vol. %, 7 vol. %, 9 vol. %, 12 vol. %, and 13 vol. %, respectively, indicated satisfactory performance as the grinding stone product. In the grinding by sample 10 and sample 11 in which the volume % of the diamond abrasive grain was 1.5 vol. % and 2.75 vol. %, respectively, however, since the diamond abrasive grain was too little and did not sufficiently appear out of the vitrified bond, the thermal conduction and the suppression of the wear by the diamond abrasive grain could not be obtained sufficiently. On the contrary, in the grinding by sample 18 in which the volume % of the diamond abrasive grain was 14 vol. %, the number of the diamond abrasive grains was too much, the clean-cutting quality had a declining tendency, and sufficient shape accuracy was not obtained. Therefore, with respect to the ratio of the diamond abrasive grain, preferable results were obtained in a range of 3 to 13 vol. %.

[Grinding Performance Evaluation Test 4]

In grinding performance evaluation test 4, samples 19 to 28 were prepared, with the same composition as that of the vitrified grinding stone of the product of the present invention used in grinding performance evaluation test 1, but with only the volume % of the vitrified bond varied, and the same grinding test as described above was performed. FIG. 13 shows results thereof. As shown in FIG. 13, results of the grinding by sample 21, sample 22, sample 23, sample 24, sample 25, and sample 26 in which the volume % of the vitrified bond was 15 vol. %, 18 vol. %, 21 vol. %, 24 vol. %, 27 vol. %, and 30 vol. %, respectively, indicated satisfactory performance as the grinding stone product. In the grinding by sample 19 and sample 20 in which the volume % of the vitrified bond was 14 vol. % and 16 vol. %, respectively, however, since the ratio of the vitrified bond was too small and an amount of protrusion of the diamond abrasive grain from the vitrified bond was 70% or more and 60% or more, respectively, resulting in unsteady holding of the diamond abrasive grain and the dropout of the diamond abrasive grain, sufficient thermal conduction and wear suppression by the diamond abrasive grain were not obtained. On the contrary, in the grinding by sample 27 and sample 28 in which the volume % of the vitrified bond was 31 vol. % and 33 vol. %, respectively, the amount of protrusion of the diamond abrasive grain from the vitrified bond was 20% or less and 10% or less, respectively, a thermal conduction effect of the diamond abrasive grain had a declining tendency, and the residual stress was not lowered sufficiently. Therefore, with respect to the ratio of the vitrified bond, preferable results were obtained in a range of 15 to 30 vol. %.

[Grinding Performance Evaluation Test 5]

In grinding performance evaluation test 5, samples 29 to 36 were prepared, with the same composition as that of the vitrified grinding stone of the product of the present invention used in grinding performance evaluation test 1, but with only the toughness value of the diamond abrasive grain varied, and the same grinding test as described above was performed. FIG. 14 shows results thereof. As shown in FIG. 14, results of the grinding by sample 31, sample 32, sample 33, sample 34, and sample 35 in which the toughness value of the diamond abrasive grain, with that of the CBN abrasive grain given as 1, was 0.4, 0.6, 0.8, 0.9, and 1.0, respectively, indicated satisfactory performance as the grinding stone product. In the grinding by sample 29 and sample 30 in which the toughness value of the diamond abrasive grain, with that of the CBN abrasive grain given as 1, was 0.2 and 0.3, respectively, however, since the destructibility of the diamond abrasive grain is too good, there was much wear of the grinding stone and a necessary grinding stone life was not obtained. On the contrary, in the grinding by sample 36 in which the toughness value of the diamond abrasive grain, with that of the CBN abrasive grain given as 1, was 1.1, since the destruction of the diamond abrasive grain is insufficient, the dressing rate was lowered. Therefore, with respect to the toughness value of the diamond abrasive grain, preferable results were obtained in a range of the value of 0.4 to 1.0 when the toughness value of the CBN abrasive grain was given as 1.

[Grinding Performance Evaluation Test 6]

In grinding performance evaluation test 6, samples 37 to 44 were prepared, with the same composition as that of the vitrified grinding stone of the product of the present invention used in grinding performance evaluation test 1, but with only the contact angle of the vitrified bond with respect to the diamond abrasive grain varied by the composition or the calcination temperature of the vitrified bond, and the same grinding test as described above was performed. FIG. 15 shows results thereof.

Figure 16:
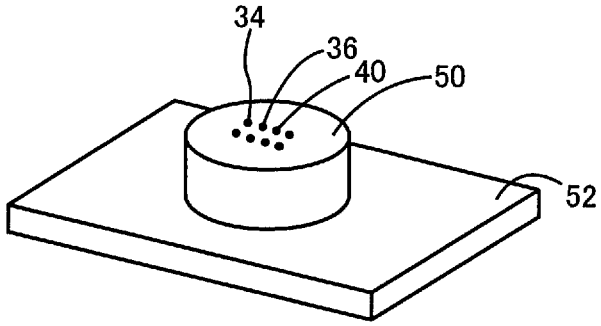
FIG. 16 is a perspective view showing a state before heating of a test piece for evaluating the wettability of an alumina abrasive grain, a CBN abrasive grain, a diamond abrasive grain included in the vitrified grinding stone strip of FIG. 2 with the vitrified bond.
Figure 17:
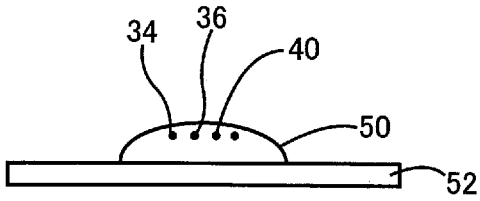
FIG. 17 is a perspective view showing a state after heating of the test piece of FIG. 16.

When the melting vitrified bond is considered as a liquid, the contact angle of the vitrified bond is an angle formed by a surface of the liquid and a wall surface of a solid in contact therewith. The contact angle of the vitrified bond is formed not only with respect to the diamond abrasive grain but it is similarly formed with respect to the CBN abrasive grain and the general abrasive grain used as the filler. This can be measured from a cross-section of an adhesion surface (sample) of the vitrified bond and the diamond, using a scanning electron microscope (SEM). FIGS. 16 and 17 are diagrams for description of an experiment that confirmed the wettability of the vitrified bond. In this experiment, firstly, the CBN abrasive grain 34, the diamond abrasive grain 36, and an alumina abrasive grain 40 are placed on a button 50 formed by press-molding powders of the vitrified bond 32 into a pellet shape. Then, this button 50, placed on a refractory plate 52, is heated, for example, at 750° C. inside a calcination furnace and the button 50 is melted down as shown in FIG. 17. The CBN abrasive grain 34, the diamond abrasive grain 36, and the alumina abrasive grain 40 on the melted button 50 are observed, using the scanning electron microscope (SEM), at a border between these abrasive grains and the vitrified bond 32. At the border between the alumina abrasive grain 40 and the vitrified bond 32, it vaguely appears as if the liquid is rising up (creeping up) over an interface. It is presumed from this that the contact angle of the alumina abrasive grain 40 relative to the vitrified bond 32 is small and that a mutual affinity of the alumina abrasive grain 40 and the vitrified bond 32 is high. At the border between the CBN abrasive grain 34 and the vitrified bond 32, it vaguely appears as if the liquid is rising up (creeping up) over the interface, but a degree of rising up is low as compared with the case of the alumina abrasive grain 40. It is presumed from this that the contact angle of the CBN abrasive grain 34 relative to the vitrified bond 32 is small and that the mutual affinity of the CBN abrasive grain 34 and the vitrified bond 32 is high but is not so great as in the case of the alumina abrasive grain 40. At the border between the diamond abrasive grain 36 and the vitrified bond 32, there is no such part in which the liquid is rising up (creeping up) over the interface, and it appears as if the liquid is repellent. It is presumed from this that the contact angle of the diamond abrasive grain 36 relative to the vitrified bond 32 is relatively large and that the mutual affinity of the diamond abrasive grain 36 and the vitrified bond 32 is relatively low.

Figure 18:
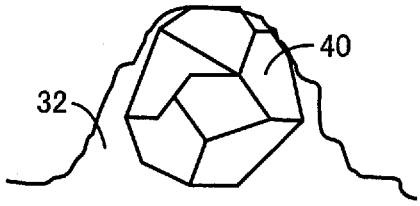
FIG. 18 is a schematic diagram for description of the wettability of the alumina abrasive grain relative to the vitrified bond.
Figure 19:
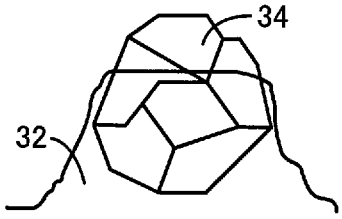
FIG. 19 is a schematic diagram for description of the wettability of the CBN abrasive grain relative to the vitrified bond.
Figure 20:
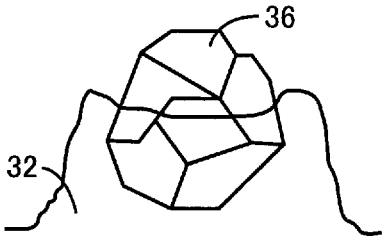
FIG. 20 is a schematic diagram for description of the wettability of the diamond abrasive grain relative to the vitrified bond.

FIGS. 18 to 20 are schematic diagrams for description of the wettability of the CBN abrasive grain 34, the diamond abrasive grain 36, and the alumina abrasive grain 40 with the vitrified bond 32, based on the above results with respect to a state, after the melting of the vitrified bond 32, of an abrasive grain located at the same position in the powders of the vitrified bond 32. The alumina abrasive grain 40 having a small contact angle and the best wettability is covered by the vitrified bond 32 after the melting of the vitrified bond 32, as shown in FIG. 18. The CBN abrasive grain 34 having a comparatively good wettability, though not so good as that of the alumina abrasive grain 40, is covered by the vitrified bond 32, with a part of the CBN abrasive grain 34 exposed and protruding, after the melting of the vitrified bond 32, as shown in FIG. 19. The diamond abrasive grain 36 having a larger contact angle and lower wettability than those of the CBN abrasive grain 34 is covered by the vitrified bond 32, with a larger part of the diamond abrasive grain 36 exposed and protruding than in the case of the CBN abrasive grain 34, as shown in FIG. 20.

As shown in FIG. 15, the results of the grinding by sample 39, sample 40, sample 41, sample 42, and sample 43 in which the contact angle of the vitrified bond relative to the diamond abrasive grain was 90°, 110°, 130°, 140°, and 150°, respectively, indicated satisfactory performance as the grinding stone product. In the grinding by sample 37 and sample 38 in which the contact angle of the vitrified bond relative to the diamond abrasive grain is 70° and 80°, respectively, however, the wettability is high and the diamond abrasive grain is embedded in the vitrified bond so that the diamond abrasive grain does not function as a grinding heat absorbing particle and has its heat absorption effect lowered. On the contrary, in the grinding by sample 44 in which the contact angle of the vitrified bond relative to the diamond abrasive grain is 160°, since the wettability of the vitrified bond with the diamond abrasive grain is poor and the holding power of the diamond abrasive grain is lowered, resulting in many dropouts, the absorption of the grinding heat by the diamond abrasive grain 36 is insufficient. In either case, it becomes hard to obtain the effect of suppressing the processing resistance and the lowering of the dressing performance.

While the above has described in detail one embodiment of the present invention with reference to the drawings, the present invention is not limited to this embodiment but can also be carried out in other modes.

For example, in the embodiment described above, the vitrified superabrasive grain grinding stone of the present invention was applied to the surface layer 30 of the vitrified grinding stone strip 26 but may be applied to a whole of the vitrified grinding stone strip 26 not having the base layer 28 or may be applied to a whole or a surface layer of a disc-shaped grinding stone, a cup-shaped grinding stone, a honing grinding stone, and a block-shaped grinding stone.

While, in the surface layer 30 of the vitrified grinding stone strip 26 of the embodiment described above, only the diamond abrasive grain 36 was used as an auxiliary abrasive grain, other abrasive grains or fillers may be added.

What was described above is merely one embodiment and, though this is not illustrated specifically, the present invention can be carried out in the modes in which various changes and improvements are added, based on the knowledge of those skilled in the art, without departing from the scope of the present invention.

NOMENCLATURE OF ELEMENTS

10: superabrasive grain grinding wheel 18: base metal (core) 24: outer peripheral surface 26: vitrified grinding stone strip (segment grinding stones, vitrified superabrasive grain grinding stone) 30: surface layer 32: vitrified bond 34: CBN abrasive grain (superabrasive grain) 36: diamond abrasive grain (superabrasive grain) 38: pore

The invention claimed is:

1. A vitrified superabrasive grain grinding stone with superabrasive grains comprising a CBN abrasive grain as a main abrasive grain and a diamond abrasive grain as an auxiliary abrasive grain bonded together by use of a vitrified bond, the auxiliary abrasive grain having an average grain diameter equal to ½ to 1/10 of that of the main abrasive grain, and the auxiliary abrasive grain having a toughness value of 0.4 to 1 when that of the main abrasive grain is given as 1.

2. The vitrified superabrasive grain grinding stone of claim 1, wherein a contact angle of the auxiliary abrasive grain with the vitrified bond is 90 to 150°.

3. The vitrified superabrasive grain grinding stone of claim 1, wherein the auxiliary abrasive grain is contained at a volume ratio of 3 to 13 volume %.

4. The vitrified superabrasive grain grinding stone of claim 1, wherein the vitrified bond is contained at a volume ratio of 15 to 30 volume %.

5. The vitrified superabrasive grain grinding stone of claim 1, comprising:

a core having a cylindrical outer peripheral surface; and a plurality of segment grinding stones attached on the outer peripheral surface of the core, wherein the segment grinding stones have the superabrasive grains bonded together by use of the vitrified bond at least in an outer peripheral side layer thereof.

* * * * *